US006209451B1

(12) United States Patent
Van Haag et al.

(10) Patent No.: US 6,209,451 B1
(45) Date of Patent: Apr. 3, 2001

(54) ROLL, CALENDER, AND PROCESS FOR OPERATING A ROLL

(75) Inventors: Rolf Van Haag, Kerken; Franz Kayser, Geldern, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/318,752

(22) Filed: May 26, 1999

(30) Foreign Application Priority Data

Jun. 3, 1998 (DE) ..... 198 24 542

(51) Int. Cl.[7] ..... B30B 9/20; B30B 15/34

(52) U.S. Cl. ..... 100/327; 100/331; 100/334; 100/336; 165/89; 165/299

(58) Field of Search ..... 100/161, 331, 100/334, 335, 336, 327; 492/46, 7, 20; 165/89, 288, 299

(56) References Cited

U.S. PATENT DOCUMENTS

| | | | | |
|---|---|---|---|---|
| 4,459,726 | * | 7/1984 | O'Brien et al. | 165/89 |
| 4,964,202 | * | 10/1990 | Pav et al. | 100/162 R |
| 5,111,564 | * | 5/1992 | Pav et al. | 165/89 |
| 5,208,955 | * | 5/1993 | Schiel | 165/89 |
| 5,289,766 | * | 3/1994 | Conrad et al. | 100/161 |
| 5,370,177 | * | 12/1994 | Fey et al. | 165/89 |
| 5,383,833 | * | 1/1995 | Brugger et al. | 492/46 |
| 5,571,066 | * | 11/1996 | Kayser | 165/89 |
| 5,784,955 | * | 7/1998 | Conrad | 100/334 |
| 5,865,716 | | 2/1999 | Kivioja et al. . | |
| 5,915,297 | * | 6/1999 | Lehtovirta et al. | 100/336 |
| 5,932,069 | | 8/1999 | Kuosa et al. . | |
| 5,984,848 | * | 11/1999 | Hyllberg et al. | 165/89 |

FOREIGN PATENT DOCUMENTS

| | | |
|---|---|---|
| 3014891 | 10/1981 | (DE) . |
| 3838852 | 5/1990 | (DE) . |
| 9206265 | 9/1992 | (DE) . |
| 4202917 | 8/1993 | (DE) . |
| 4223359 | 1/1994 | (DE) . |
| 19513500 | 10/1996 | (DE) . |
| 0567875 | 11/1993 | (EP) . |
| 0661469 | 7/1995 | (EP) . |
| 0796946 | 9/1997 | (EP) . |
| 97/15721 | 5/1997 | (WO) . |

* cited by examiner

*Primary Examiner*—Peter Vo
*Assistant Examiner*—Louis Huynh
(74) *Attorney, Agent, or Firm*—Greenblum & Bernstein, P.L.C.

(57) ABSTRACT

Roll for a paper calender. The roll includes a core having opposed end faces and a barrel intermediate the opposed end faces, the barrel having a barrel region. Also included is an elastic cover extending over a working width of the core and a plurality of roller pins, each roller pin engaging a respective end face and having a pin region. Also provided is a temperature control device adapted to supply heat to and/or dissipate heat from the pin regions to a first temperature, and further adapted supply heat to and/or dissipate heat from the barrel region to a second temperature, wherein the first and the second temperatures are different. The present invention also provides a calender that employs such a roll having an elastic cover. Additionally provided is a process for operating such a roll having an elastic cover.

26 Claims, 3 Drawing Sheets

ROLL, CALENDER, AND PROCESS FOR OPERATING A ROLL

CROSS-REFERENCE TO RELATED APPLICATIONS

The present application claims priority under 35 U.S.C. § 119 of German Patent Application No. 198 24 542.4, filed on Jun. 3, 1998, the disclosure of which is expressly incorporated by reference herein in its entirety.

BACKGROUND OF THE INVENTION

1. Field of the Invention

The invention relates to a roll, a calender and a process for operating a roll, and more particularly, to a roll with a core that has an elastic cover extending over a working width and with roller pins on the end faces of the core.

2. Discussion of Background Information

Calender rolls having an elastic cover have been used as a middle roll in a roll stack of a calender. These rolls are often called a soft or elastic calender roll, because the cover causes the surface of the roll to be elastic to a certain degree. A calender roll of this kind cooperates with a "hard" roll in order to satinate a paper web or another material web.

The hard roll is often heated so that the paper web can be acted on with increased pressure and increased temperature in the nip formed between the soft roll and the hard roll. The elastic cover is used primarily for uniform compression of the paper web.

The working width of such a calender roll corresponds to the width of the material web to be treated. The cover can taper conically outside the working width. This tapering extends over an axial length in the size range of approximately 20 to 100 mm. This length prevents the part of the cover that is not covered by a paper web from coming into contact with the counter roll and being damaged. For future reference, only the working region of the cover is referred to as the working width.

Rolls are often damaged during operation because the cover tears or breaks. This damage occurs even in very temperature-resistant or temperature-proof covers that are actually supposed to withstand the temperatures during operation.

Working with heat-carrying mediums is intrinsically known in the related art, for example, from cooling or heating rolls. However, these rolls do not have an elastic cover. Heretofore, when elastic rolls have been temperature controlled, this control occurred by using air to cool the cover.

SUMMARY OF THE INVENTION

The present invention provides a roll for a paper calender. The roll includes a core having opposed end faces and a barrel intermediate the end faces, the barrel having a barrel region. An elastic cover extends over a working width of the core, and a plurality of roller pins are provided, each roller pin engaging an end face and having a pin region. Also provided is a temperature control device adapted to supply heat to and/or dissipate heat from the pin regions to a first temperature, and further adapted supply heat to and/or dissipate heat from the barrel region to a second temperature, wherein the first and the second temperatures are different.

In another arrangement of the invention, the roll may include a core having opposed end faces and a barrel intermediate the end faces, the barrel having a barrel region. An elastic cover extends over a working width of the core, and a plurality of roller pins are provided, each roller pin engaging an end face and having a pin region. Also provided is a temperature control device adapted to control the temperature of the pin regions to a first temperature, and further adapted to control the temperature of the barrel region to a second temperature, wherein the first and the second temperatures are different.

The temperature control device may include a flow path for transporting a heat-carrying medium into and out of the roll. The temperature control device may further be adapted to adjust the temperature of the heat-carrying medium as a function of line load and roll temperature. Furthermore, the temperature of the heat-carrying medium upon entry into the roll and the temperature of the heat-carrying medium upon exit from the roll may differ by no more than approximately 3° C.

Additionally, the roll may further have a displacement body disposed within the core that forms an annular chamber with the inner surface of the core.

A plurality of peripheral bores evenly disposed about the circumference and along the length of the core may further be provided.

Still further, a first heat exchange surface area present on each the pin region and a second heat exchange surface area present on the barrel region may be provided, wherein the first heat exchange surface area is greater than the second heat exchange surface area.

The flow speed of the heat-carrying medium in the barrel region may be greater than the flow speed of the heat-carrying medium in the pin regions.

Also, a predetermined portion of each pin region may extend beyond the working width of the core, and the temperature control device may internally cool the portion of each pin region that extends beyond the working width of the core.

Additionally, the temperature of the heat-carrying medium may be between the temperature of the pin regions and the temperature of the barrel region.

The present invention also provides a calender comprising a plurality of rolls having any or all of the above-mentioned characteristics.

The process for operating a roll according to the present invention includes adjusting temperature progression in an axial direction of the core, as a function of the temperature in the vicinity of the roll and a line load acting upon the roll.

The process may also include heating the roller pins and the barrel. Further, the process may include charging the roll with a heat-carrying medium having an initial temperature between the temperature at the roll ends and the temperature at the axial center of the roll.

Additionally, the process may include cooling the roller pins more intensely than the cooling of the center of the roll.

The process may still further include performing one of supplying heat to and dissipating heat from the pin regions to a first temperature, and performing one of supplying heat to and dissipating heat from the barrel region to a second temperature, the first and second temperatures being different. Further, the process may alternatively include controlling the temperature of the pin regions to a first temperature and controlling the temperature of the barrel region to a second temperature, the first and second temperatures being different.

The process may also include disposing an annular chamber between a displacement body and an inner surface of the core.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PRESENT INVENTION

Figure 1:
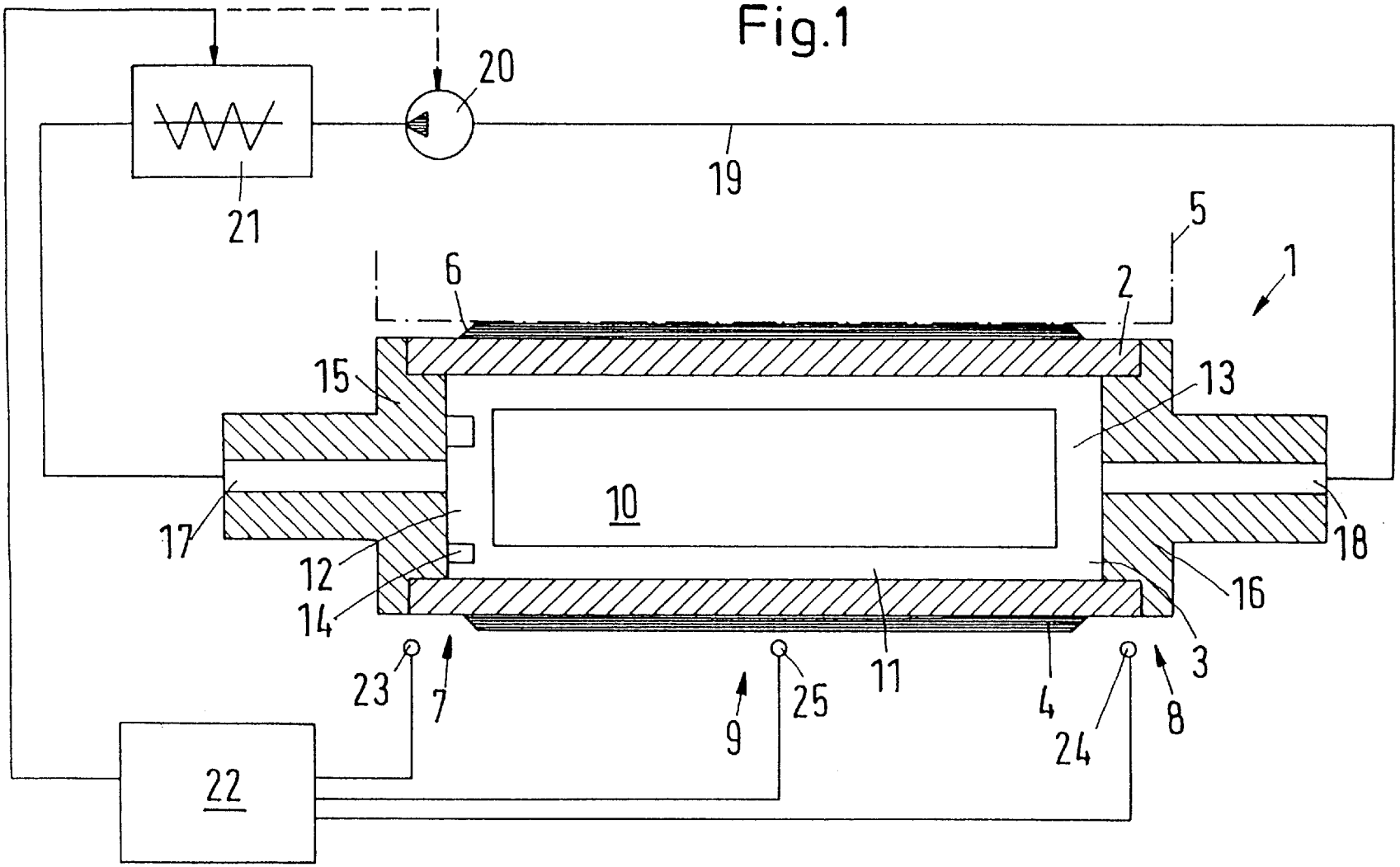
FIG. 1 is a schematic cross-sectional view of an elastic roll.

The present invention reduces the stress on a cover of a roll. A temperature control device is provided, which supplies heat to and/or dissipates heat from the pin regions to a first temperature, and further supplies heat to and/or dissipates heat from the barrel region to a second temperature, the first and second temperatures being different.

During operation, various external influencing factors act on a roll. One influencing factor is externally supplied heat which is produced by roll friction of the covers in the nip. A large part of the heat is also transmitted to the elastic roll by the paper web that has been heated by a counter roll. Additionally, heat may also be supplied due to the flexing of the cover. Heat may further be supplied by a roll used for treating other material webs, for example, foils made of plastic or metal, or cardboard webs.

The temperature of the area axially outside the cover (i.e., the portion of the roll not covered by the cover) is different than the temperature of the area covered by the cover, as there is no heat supplied through friction and flexing, and there is no heat transmitted by the heated paper or material web. Radiation of heat is more intense at the regions of the core that are not covered by the cover. Thus, a higher temperature occurs in the barrel region (i.e., in the region of the axial center of the roll), causing varying radial expansion of the roll over the length thereof, and producing a diameter that is smaller at the axial ends than the diameter in the direction of the axial center.

A line load can be exerted on the roll during operation by one counter roll, but is generally exerted by two counter rolls. This line load causes a mechanical deformation of the outer surface, which has a large influence on the cylindrical nature of the elastic roll. In other words, due to the line load, a smaller diameter is produced in the barrel region than in the pin regions. During operation, the diameter changes due to uneven temperature distribution, and the diameter also changes due to the applied line load. In extremely rare instances, the desired roll profile is produced in which the outer diameter of the cover remains constant over the axial length. The greatest diameter (and therefore also the greatest stress on the cover), is produced in the edge regions of the cover. In some situations, the cover can no longer withstand this stress and breaks.

With a temperature control device, which acts on the pin region in a thermally different manner than it does on the barrel region, diameter correction can now be performed over the axial length of the roll. However, this correction only works if the pin regions are treated in a thermally different manner than the barrel region. Thus, a different diameter change in the pin regions than in the barrel region is thermally produced (i.e., produced through the supply and dissipation of heat). With a corresponding temperature control, diameter progression can be produced that is constant over the axial length of the roll, resulting in an evening out of the stress so that the cover is protected.

In a certain embodiment, the temperature control device has a flow path for a heat-carrying medium. With the heat-carrying medium, heat can be transported into the roll or out of the roll. However, in some cases this device is not necessary because it is possible to act on the pin regions of the roll in a thermally different manner than on the barrel region, solely based on the fact that a heat-carrying medium flows through. It is necessary to adapt the temperature of the heat-carrying medium very precisely not only to the temperature of the roll, but also to the temperature and load distribution of the roll and to other environment-related conditions.

Preferably, a displacement body is arranged in the roll, which creates an annular chamber between the displacement body and an inner surface of the core, thereby reducing the volume that must be filled by the heat-carrying medium. Since the roll does not need as large a quantity of heat-carrying medium, the inertial momentum changes only within tolerable amounts. Moreover, with the displacement body, it is possible to not only predetermine certain flow paths, but to also ascertain certain flow characteristics to these flow paths, which can easily change over the axial length of the roll.

Alternatively or additionally, the core can have a large number of peripheral bores evenly disposed about the circumference and along the length of the core. The heat-carrying medium may also be conveyed through these bores. Peripheral bores have the advantage over a displacement body in that they can influence the temperature closer to the surface of the roll and as a result, the heat-carrying medium can act more rapidly and directly. A displacement body is advantageous in that it can also be retrofitted to existing rolls that are utilized as pin rolls (i.e., having a tubular body).

A temperature control device is advantageously provided, which adjusts the temperature of the heat-carrying medium as a function of the line load and the roll temperature. It is not absolutely necessary to provide a regulation device which receives temperature values actually measured on the roll surface and a line load value actually measured on the roll as input quantities. Rather, the roll temperature and the line load can be calculated with sufficient precision (for example from a known initial temperature of the heated counter roll, the pressure application on upper and lower roll, and the roll weights of the calender) and the temperature of the heat-carrying medium can be adjusted as a function of these calculated values. Thus, this temperature, possibly in an iterative fashion, has an influence on the calculation. Therefore, thermally induced diameter changes of the roll, which have not yet been compensated for by the line load, can be thermally compensated. In doing so, the pin regions are acted on differently than in the barrel region. Additionally, the temperature control device functions precisely within a few degrees.

It is also advantageous that the temperature difference between the entry and exit of the heat-carrying medium is at most approximately 3° C. One advantage is that the two axial ends of the roll are treated the same. Another advantage is that it is not necessary to utilize the heat-carrying medium to intrinsically heat or cool the roll, although it is acceptable if the heat-carrying medium removes some heat from the roll. The main purpose of this arrangement, however, is to equalize or compensate for the thermally-induced diameter differences that are not compensated for by the line load (i.e., to even out the diameter distribution over the axial length of the roll), at least over the axial length of the cover.

Preferably, there is a larger heat exchange surface area in the pin regions than in the barrel region. As a result, the heat-carrying medium can apply a greater quantity of heat to the pins or absorb a greater quantity of heat from the pins than it can in the barrel region. The necessity for thermal correction is the greatest at the pin regions, however.

Alternatively or additionally, the flow speed of the heat-carrying medium can be greater in the barrel region than the flow speed in the pin region. Therefore, the heat-carrying medium in the barrel region has less time to absorb or give off heat. The thermal influence on the roll is therefore smaller in the barrel region.

In a certain arrangement, the temperature control device internally cools the pin regions that are outside of the cover. This arrangement is preferably used when the diameter changes due to the outer surface deformations produced by the line load are greater than the thermally-induced deformations. It may appear that cooling the regions of the pin not covered by the cover would be useless because it would appear insignificant whether or not there were diameter changes in these regions. In actuality, however, both the thermally-induced diameter changes and the mechanical stresses induced by the diameter reductions radiate so far into the region beneath the cover that the desired diameter reduction and therefore stress reduction also occurs.

In another arrangement, which is preferably used when thermally-induced deformations are greater than the changes produced by the line load, the temperature of the heat-carrying medium lies between the temperature of the pin regions and the temperature of the barrel region. The roll is neither supplied with heat nor does it give off heat. The temperature of the heat-carrying medium is preferably exactly the same as the temperature of the roll. This measure, however, results in the pins being heated and the barrel being cooled. As a result, the diameter increases in the pin regions and the diameter decreases in the barrel region, thereby evening the diameter of the roll. Small quantities of heat may still be supplied to the roll or given off by it, however. This cooling or heating could also be produced in another manner at a low cost. Importantly, in this arrangement, heat transport occurs only toward the pins and away from the barrel region.

In a calender of the present invention, each roll has its own temperature control device. The calender may have a number of soft or elastic rolls disposed one above the other, with hard, heated rolls preferably disposed therebetween. Both the temperature distribution of the rolls and the pressure loading or line load distribution can vary from the top of the calender to the bottom. Since the line load in each nip also influences the roll deformation and therefore necessitates a thermal correction, a separate temperature control device is advantageously provided for each roll. Each roll is thus corrected individually.

Temperature progression in the axial direction is adjusted, which depends on the temperature in the vicinity of the roll and further depends on a line load acting thereon. The roll is not only simply cooled or heated as a whole; temperature progression is intentionally adjusted. This temperature progression is not only a function of the temperature in the vicinity of the roll, but also is a function of the line load acting on the roll. The temperature in the vicinity of the roll, which leads to the heating of the roll, results in a thermally-induced diameter increase. The line load in turn, reduces the diameter. As explained above, the two effects cancel each other out.

A fine correction with the aid of a deliberate temperature adjustment, however, results in an extensive reduction of the pressure loading of the elastic cover. In doing so, the roller pins may be heated and the barrel region may be cooled. It is not necessary for heat to be supplied to or dissipated from the roll as a whole for this purpose. However, heating the pin regions causes a diameter increase at these regions, which, with a corresponding reduction of the diameter in the barrel region, evens out the diameter of the roll.

Preferably, the roll is charged with a heat-carrying medium with an initial temperature ranging between the temperature at the roll ends and the temperature at the axial center of roll. This arrangement is effective for heating the roll ends and for cooling the center of the roll with the aid of a single heat-carrying medium.

Alternatively, the roller pins can be more intensely cooled than the center of the roll. In such a situation, heat is removed from the roll, but it is not a cooling roll. The process temperature generally remains unaltered. The cooling serves to even out the diameter of the roll.

Referring to the drawings wherein like numerals represent like elements, FIG. 1 shows a roll 1 with a core 2, as a tube and enclosing a cavity 3. An elastic cover 4 is disposed about the circumferential surface of the core 2, and is shown in FIG. 1 depicted with exaggerated thickness for ease of reference. The cover 4 does not extend over the entire axial length of the roll 1, but over a working width which corresponds to the width of a paper web to be treated.

The roll 1 cooperates with a counter roll 5 (schematically depicted), the counter roll preferably being a heating roll. The paper web is conveyed through a nip 6 between the two rolls 1, 5 and is acted upon by increased pressure and increased temperature in this nip 6.

On the two axial ends of the roll 1, the cover 4 leaves pin regions 7, 8 clear (i.e., uncovered). A region between the pin regions 7, 8 is referred to as the barrel region 9.

A displacement body 10 is disposed in the cavity 3 and forms an annular gap 11 with the core 2. Distributor chambers 12, 13 are disposed on the end faces of the displacement body 10. While heat conducting plates 14 are shown in the distributor chamber 12, corresponding heat-conducting surfaces can also be disposed in the distributor chamber 13, if necessary. In lieu of the annular gap 11, peripheral bores (not shown) in the core 2 can also be provided.

The cavity 3 is closed at both ends by roller pins 15, 16. A conduit 17, 18 for a heat-carrying medium (for example, water) leads through each of the roller pins 15, 16. The conduits 17, 18 are connected to each other by an annular line 19 in which a pump 20 and a heat exchanger 21 are present. Both the pump 20 and the heat exchanger 21 are connected to a control unit 22 and are controlled thereby. The volumetric flow of the heat-carrying medium through the roll 1 may also be kept constant. The connection of the control unit 22 to the pump 20 is shown with dashed lines.

In one embodiment, the control unit 22 can be connected to temperature sensors 23, 24, 25. Temperature sensors 23 and 24 detect the temperature of the roll 1 in the pin regions 7, 8. Temperature sensor 25 detects the temperature of the roll 1 in the barrel region. The forces applied in the nip 6 may be applied by the forces existing in the calender, which are produced by the pressures on the top and bottom roll and the weights of the rolls. These sensors 23, 24, 25 may be omitted if the temperature in the vicinity of the rolls, particularly the temperature of the counter roll, are known. Additionally, the sensors 23, 24, 25 may also be omitted if there are a number of counter rolls, and the temperature of the counter rolls and/or paper rolls are known, as well as the temperature of the roll loads that have been adjusted. This information can be used to calculate the temperature distribution, the line load distribution, and also the resulting deformations of the roll 1. Since the local temperature changes produced by the heat-carrying medium also influence the temperature progression, calculation can be carried out iteratively.

The control unit adjusts the heat exchanger 21 so that the heat-carrying medium (for example, water) flowing through the roll 1 has a clearly defined temperature, independent of how the information input for the control unit 22 is generated. The heat-carrying medium is used neither to heat nor to cool the roll 1 (i.e., the process temperature on the surface of the cover 4 is practically unchanged). If necessary, it is acceptable for a small heat quantity to be given off by the roll 1. Preferably, the temperature difference between entry and exit of the heat-carrying medium should not exceed approximately 3° C.

Figure 2:
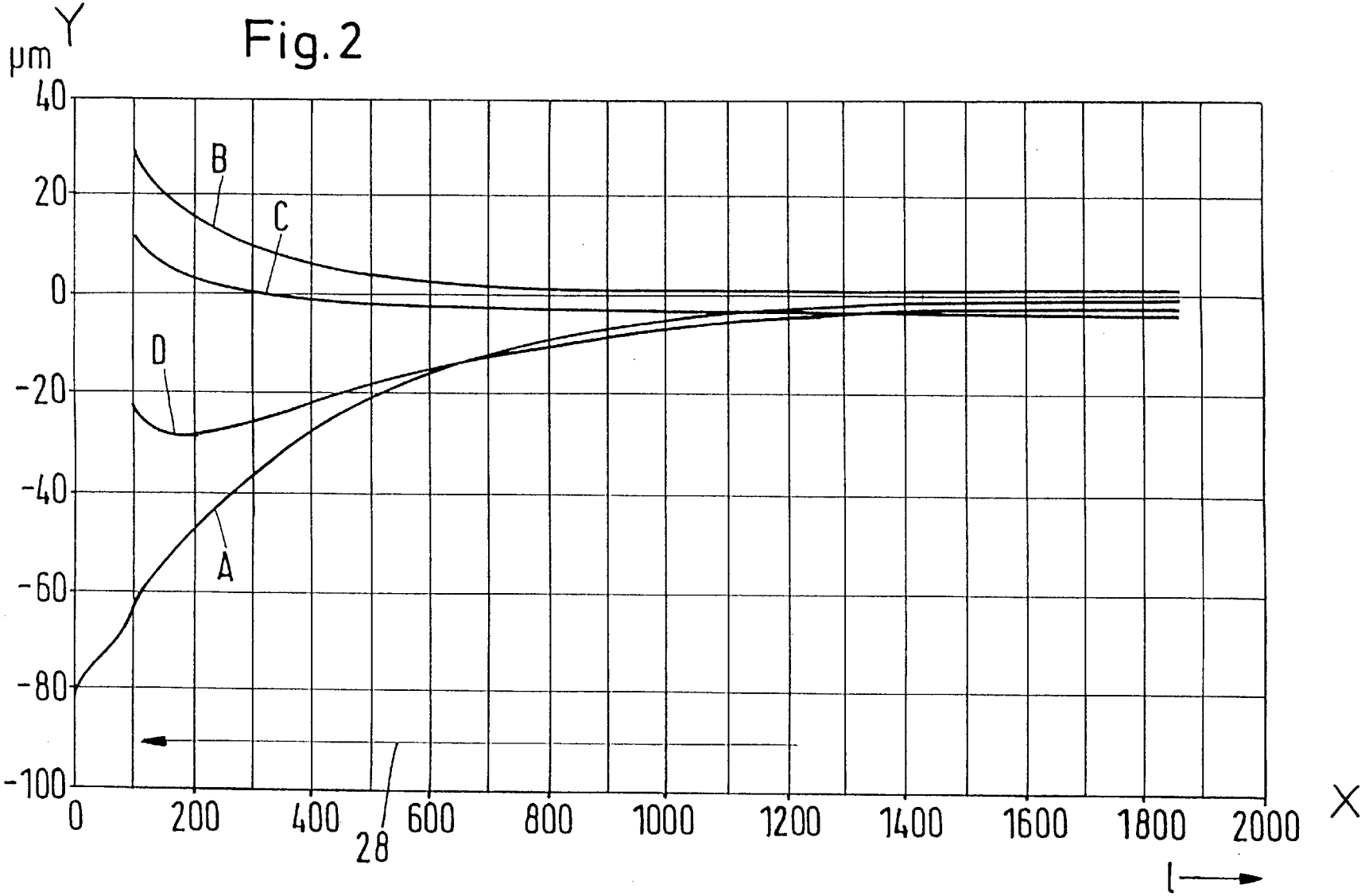
FIG. 2 is a schematic depiction of different curves which may be used to determine the ideal temperature of the heat-carrying medium.

FIG. 2 shows different curves A, B, C, D which may be used to determine the ideal temperature of the heat-carrying medium that should be present at its exit from the heat exchanger 21. The length "1" of the roll 1 (in millimeters) is plotted along the X-axis. The deviation of the diameter from a reference diameter 0 (in $\mu$m) is plotted along the Y-axis. An arrow 28 indicates on which region the paper web is resting (i.e., what the span of the cover 4 is in the axial direction).

Curve A shows which diameter deviations are produced by thermal influences (i.e., by the temperatures that exist during operation). Such a curve can be determined with known calculation processes, for example, according to finite element methods.

Curve B shows diameter changes of the roll 1 over the axial length "1," which are caused by line loads. In contrast to thermal effects, which reduce the diameter toward the axial end, the line loads produce a reduction of the diameter toward the axial center, or conversely expressed, produce a diameter increase toward the axial ends.

Curve C shows the corresponding deviations for the counter roll 5, which is preferably a heating roll.

Curve D shows the sum of the diameter deviations (i.e., the sum of the diameter increases of the rolls 1 and 5), which are produced by line loads, minus the diameter reduction of the roll 1 that is thermally induced. A "diameter error" of almost 30 $\mu$m occurs in the edge region of the cover 4, which is first balanced out to zero relatively far inward (i.e., relatively far toward the axial center of the roll).

In the locations where the diameter or the sum of the diameters is too small, the rolls do not rest against one another with the same pressure as the pressure in the axial center. The line load is then concentrated at the edge of the regions in which the two rolls 1, 5 rest against each other "normally", where damage may often occur.

It is now clear from the "sum curve" D that the diameter of the roll 1 is too small in the edge regions or pin regions 7, 8. If these pin regions 7, 8 are now supplied with a corresponding quantity of heat, then the diameter of roll 1 increases in these pin regions 7, 8 because the temperature there increases. However, the temperature in the barrel region is not permitted to increase to the same extent. In this instance, there would only be a shifting of the sum curve D upward or downward without evening out the diameter distribution over the axial length 1 of the roll 1. It is even more advantageous to cool the barrel region 9.

The heat conducting plates 14 supply the pins with a greater quantity of heat than the barrel region 9. Therefore, a larger heat exchange surface area in the roll 1 is available only in those areas where a higher heat quantity is intended be applied to the roll 1.

The annular gap 11 in the barrel region has a smaller flow cross section than the distributor chambers 12, 13, for example. The heat-carrying medium thus flows faster through the barrel region 9, 10 and correspondingly cannot contribute well to heat exchange. These measures, however, are only intended by way of example, and in alternative embodiments, other measures may be used for controlling the temperature differently in the pin regions 7, 8 than in the barrel region 9, while still using the same heat-carrying medium.

As seen in FIG. 2, heating of the pin regions 7, 8 and cooling of the barrel region 9 can easily be carried out. The temperature value of the heat-carrying medium thus lies between the temperature value in the pin regions 7, 8 and the temperature value in the barrel region 9. The overall heat balance of the roll 1 thus remains practically unchanged. On the average, the roll 1 is supplied with a heat-carrying medium having a temperature corresponding to the temperature of the roll 1. However, if the influence of the line load is dominant (shown by curves B and C), the pin regions 7, 8 may have to be more strongly cooled than the barrel region 9. This influence varies from roll to roll, however, and can be calculated in advance of cooling.

Figure 3:
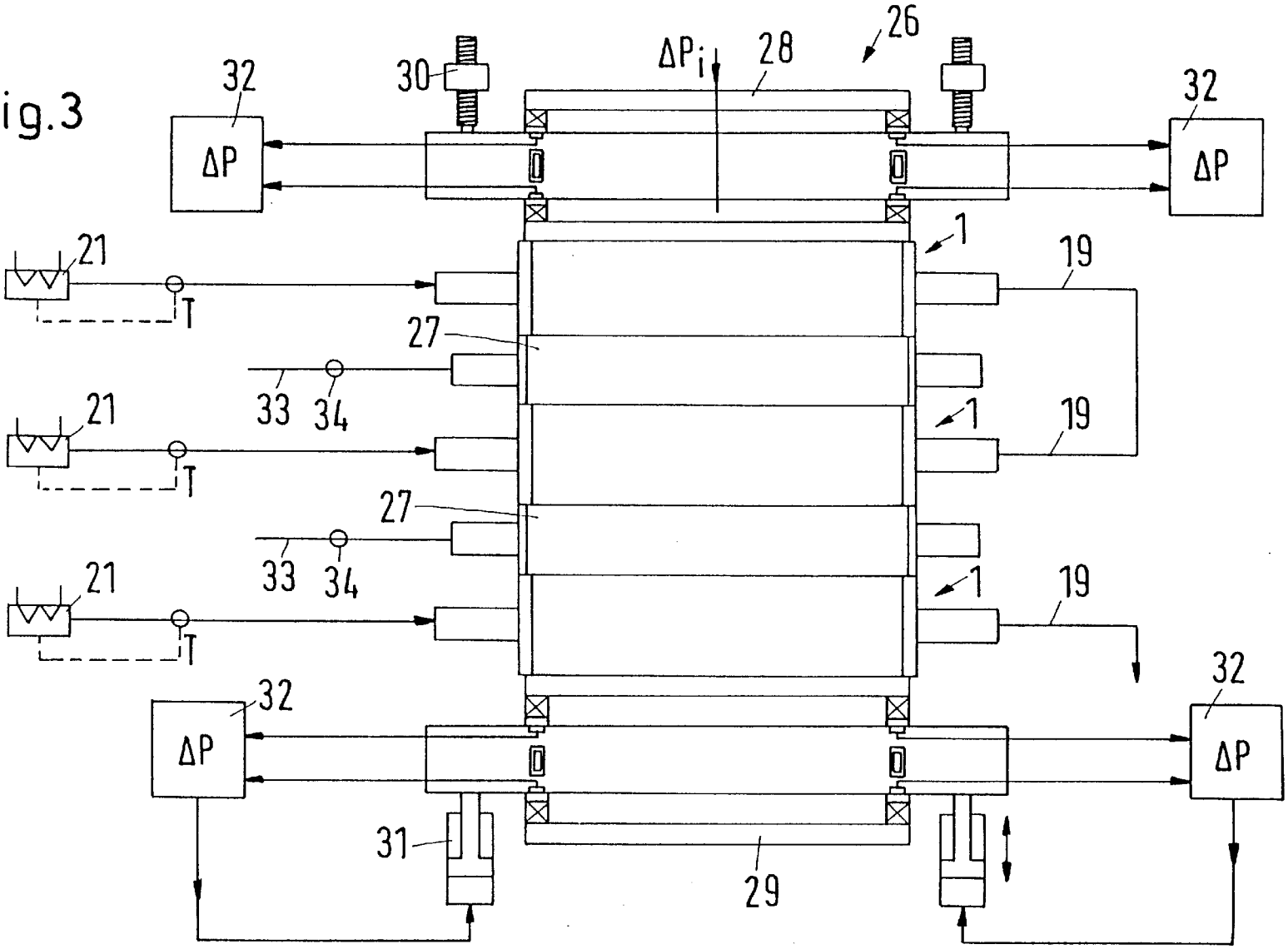
FIG. 3 shows a calender with several elastic rolls.

Similarly, if a number of rolls 1 are used in a calender 26, as shown in FIG. 3, a separate temperature control device may be provided for each roll 1 (i.e., a separate circuit 19 with a heat exchanger 21). Each heat exchanger 21 can then be individually controlled. The return of the circuits 19 may also be combined.

Hard, heated rolls 27, which may correspond to the roll 5 shown in FIG. 1, are disposed between the soft or elastic rolls 1 in the calender 26. Furthermore, a top roll 28 and a bottom roll 29 are provided with pressure application devices 30, 31, which are responsible for producing the line loads. In the top roll 28 and the bottom roll 29, the forces applied can be measured using pressure sensors 32 and the line load distribution in the individual nips can then be calculated from this value.

The heating rolls 27 are supplied with a heating medium (for example, water or steam) by way of lines 33. The temperature of this heating medium can be detected with the aid of temperature sensors 34. Since the temperature of the heating rolls 27 during operation is a function of the initial temperature of the heating medium, the detection of the initial temperature with the aid of the temperature sensors 34 is sufficient in order to obtain the necessary information for calculating the temperature distribution in the rolls 1. It is also sufficient that the temperatures of adjacent heating rolls 27 are taken into account when calculating the temperature progression in a roll 1.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A roll for a paper calender, comprising:

a core having opposed end faces and a barrel intermediate said opposed end faces, said barrel having a barrel region;

an elastic cover extending over a working width of said core;

a plurality of roller pins, each roller pin engaging a respective said opposed end face in a pin region of the elastic cover;

a source for supplying a heat-carrying medium; and a temperature control device arranged to adjust a temperature of the medium to flow through said roll, to thereby one of: (a) supply heat to the pin regions while removing heat from the barrel region, and (b) remove heat from the pin regions while supplying heat to the barrel region.

2. The roll according to claim 1, wherein said temperature control device comprises a flow path adapted to transport the heat-carrying medium into and out of the roll.

3. The roll according to claim 2, wherein said core has an inner surface and an outer surface, the roll further comprising a displacement body disposed within said core, said displacement body defining an annular chamber between said displacement body and said inner surface of said core.

4. The roll according to claim 2, further comprising a plurality of peripheral bores evenly disposed about the circumference and along the length of said core.

5. The roll according to claim 2, wherein said temperature control device adjusts the temperature of the heat-carrying medium as a function of: (a) a line load exerted on said roll by at least one counter roll, and (b) a temperature of said roll.

6. The roll according to claim 5, wherein roll temperature is calculated from at least one of a known initial temperature of a heated counter roll, a pressure application on an upper and lower roll, and the roll weights of a calender.

7. The roll according to claim 5, further comprising a regulation device arranged to receive temperature values actually measured on the roll surface and to receive a line load value actually measured on the roll as input quantities.

8. The roll according to claim 2, wherein the flow speed of the heat-carrying medium in said barrel region is greater than the flow speed of the heat-carrying medium in said pin regions.

9. The roll according to claim 2, wherein a predetermined portion of each said pin region extends beyond said working width of said core, and wherein said temperature control device is adapted to internally cool said predetermined portion of each said pin region that extends beyond said working width of said core.

10. The roll according to claim 1, further comprising:

a medium inlet coupled to said medium source, wherein said temperature control device adjusts the temperature of the medium before said medium inlet.

11. A roll for a paper calender, comprising:

a core having opposed end faces and a barrel intermediate said opposed end faces, said barrel having a barrel region;

an elastic cover extending over a working width of said core;

a plurality of roller pins, each roller pin engaging a respective said opposed end face in a pin region of the elastic cover;

a source for supplying a heat-carrying medium; and a temperature control device arranged to adjust a temperature of the medium to flow through said roll, to thereby one of: (a) supply heat to the pin regions while removing heat from the barrel region, and (b) remove heat from the pin regions while supplying heat to the barrel region, wherein said temperature control device comprises a flow path adapted to transport the heat-carrying medium into and out of the roll; and wherein the temperature of the heat-carrying medium upon entry into the roll and the temperature of the heat-carrying medium upon exit from the roll, differs by no more than 3° C.

12. A roll for a paper calender, comprising:

a core having opposed end faces and a barrel intermediate said opposed end faces, said barrel having a barrel region;

an elastic cover extending over a working width of said core;

a plurality of roller pins, each roller pin engaging a respective said opposed end face in a pin region of the elastic cover;

a source for supplying a heat-carrying medium; and a temperature control device arranged to adjust a temperature of the medium to flow through said roll, to thereby one of: (a) supply heat to the pin regions while removing heat from the barrel region, and (b) remove heat from the pin regions while supplying heat to the barrel region, wherein said temperature control device comprises a flow path adapted to transport the heat-carrying medium into and out of the roll;

said flow path having a first heat exchange surface area disposed in each said pin region and a second heat exchange surface area present on said barrel region; and wherein said first heat exchange surface area is greater than said second heat exchange surface area.

13. A roll for a paper calender, comprising:

a core having opposed end faces and a barrel intermediate said opposed end faces, said barrel having a barrel region;

an elastic cover extending over a working width of said core a plurality of roller pins, each roller pin engaging a respective said opposed end face in a pin region of the elastic cover;

a source for supplying a heat-carrying medium; and a temperature control device arranged to adjust a temperature of the medium to flow through said roll, to thereby one of: (a) supply heat to the pin regions while removing heat from the barrel region, and (b) remove heat from the pin regions while supplying heat to the barrel region, wherein said temperature control device comprises a flow path adapted to transport the heat-carrying medium into and out of the roll;

wherein the temperature of the heat-carrying medium is between the temperature of said pin regions and the temperature of said barrel region.

14. A roll for a paper calender, comprising:

a core having opposed end faces and a barrel intermediate said opposed end faces, said barrel having a barrel region;

an elastic cover extending over a working width of said core;

a plurality of roller pins, each roller pin engaging a respective said opposed end face in a pin region of the elastic cover;

a source for supplying a heat-carrying medium; and a temperature control device which adjusts a temperature of the heat-carrying medium flowing through said roll to adjust a temperature of said roll between a temperature of said pin region and a temperature of said barrel region.

15. The roll according to claim 14, wherein said temperature control device comprises a flow path adapted to transport the heat-carrying medium into and out of the roll.

16. The roll according to claim 15, wherein said core has an inner surface and an outer surface, the roll further comprising a displacement body disposed within said core, said displacement body defining an annular chamber between said displacement body and said inner surface of said core.

17. The roll according to claim 15, further comprising a plurality of peripheral bores evenly disposed about the circumference and along the length of said core.

18. The roll according to claim 15, wherein said temperature control device adjusts the temperature of the heat-carrying medium as a function of: (a) a line load exerted on said roll by at least one counter roll, and (b) a temperature of said roll.

19. The roll according to claim 18, wherein roll temperature is calculated from at least one of a known initial temperature of a heated counter roll, a pressure application on an upper and lower roll, and the roll weights of a calender.

20. The roll according to claim 18, further comprising a regulation device arranged to receive temperature values actually measured on the roll surface and to receive a line load value actually measured on the roll as input quantities.

21. The roll according to claim 15, wherein the flow speed of the heat-carrying medium in said barrel region is greater than the flow speed of the heat-carrying medium in said pin regions.

22. The roll according to claim 15, wherein a predetermined portion of each said pin region extends beyond said working width of said core, and wherein said temperature control device is adapted to internally cool said predetermined portion of each said pin region that extends beyond said working width of said core.

23. A roll for a paper calender, comprising:

a core having opposed end faces and a barrel intermediate said opposed end faces, said barrel having a barrel region;

an elastic cover extending over a working width of said core;

a plurality of roller pins, each roller pin engaging a respective said opposed end face in a pin region of the elastic cover;

a source for supplying a heat-carrying medium;

a temperature control device which adjusts a temperature of the heat-carrying medium flowing through said roll to adjust a temperature of said roll between a temperature of said pin region and a temperature of said barrel region;

wherein said temperature control device comprises a flow path adapted to transport the heat-carrying medium into and out of the roll;

wherein the temperature of the heat-carrying medium upon entry into the roll and the temperature of the heat-carrying medium upon exit from the roll, differs by no more than 3° C.

24. A roll for a paper calender, comprising:

a core having opposed end faces and a barrel intermediate said opposed end faces, said barrel having a barrel region;

an elastic cover extending over a working width of said core;

a plurality of roller pins, each roller pin engaging a respective said opposed end face in a pin region of the elastic cover;

a source for supplying a heat-carrying medium; and a temperature control device which adjusts an average a temperature of the heat-carrying medium flowing through said roll to adjust a temperature of said roll between a temperature of said pin region and a temperature of said barrel region;

wherein said temperature control device comprises a flow path adapted to transport the heat-carrying medium into and out of the roll; and said flow path having a first heat exchange surface area disposed in each said pin region and a second heat exchange surface area disposed in said barrel region; and wherein said first heat exchange surface area is greater than said second heat exchange surface area.

25. A roll for a paper calender, comprising:

a core having opposed end faces and a barrel intermediate said opposed end faces, said barrel having a barrel region;

an elastic cover extending over a working width of said core a plurality of roller pins, each roller pin engaging a respective said opposed end face in a pin region of the elastic cover;

a source for supplying a heat-carrying medium; and a temperature control device which adjusts a temperature of the heat-carrying medium flowing through said roll to adjust a temperature of said roll between a temperature of said pin region and a temperature of said barrel region;

wherein said temperature control device comprises a flow path adapted to transport the heat-carrying medium into and out of the roll;

wherein the temperature of the heat-carrying medium is between the temperature of said pin regions and the temperature of said bar region.

26. A calender comprising a plurality of rolls, each roll of said plurality of rolls comprising:

a core having opposed end faces and a barrel intermediate said opposed end faces, said barrel having a barrel region;

an elastic cover extending over a working width of said core;

a plurality of roller pins, each roller pin engaging a respective said opposed end face in a pin region of the elastic cover;

a source for supplying a heat-carrying medium; and a temperature control device arranged to adjust a temperature of the medium to flow through said roll, to thereby one of: (a) supply heat to the pin regions while removing heat from the barrel region, and (b) remove heat from the pin regions while supplying heat to the barrel region.

* * * * *